US006115841A

United States Patent [19]

Thompson, II et al.

[11] Patent Number: 6,115,841

[45] Date of Patent: Sep. 12, 2000

[54] NECKTIE WITH ATTACHING OUTWARDLY CONCEALED EYEGLASS WIPING DEVICE

[76] Inventors: Richard E. Thompson, II, 2051 Fairhaven Cir., Atlanta, Ga. 30305; Leonor F. Loree, IV, 332 Golfview Rd., Atlanta, Ga. 30309

[21] Appl. No.: 09/309,324

[22] Filed: May 11, 1999

[51] Int. Cl.[7] ..... A41D 25/00

[52] U.S. Cl. ..... 2/144; 2/157

[58] Field of Search ..... D2/600, 605, 602, D2/609; 2/144, 145, 156, 157; 24/49.1, 66.1, 66.2; 442/60, 308, 351; 428/903

[56] References Cited

U.S. PATENT DOCUMENTS

| | | | |
|---|---|---|---|
| Re. 30,950 | 6/1982 | Ackerman | 2/144 |
| 1,772,575 | 8/1930 | Costanzo | 2/144 |
| 4,525,411 | 6/1985 | Schmidt | 428/198 |
| 5,142,703 | 9/1992 | Basinger et al. | 2/144 |
| 5,435,011 | 7/1995 | Nicolai | 2/145 |
| 5,463,779 | 11/1995 | Pinkus | 2/144 |

*Primary Examiner*—John J Calvert
*Assistant Examiner*—Alissa Hoey

[57] ABSTRACT

A cleaning cloth wiper for glass lenses that is permanently attached to the back of each of the ends of a necktie, thereby providing the eyeglass wearing professional an immediately available means of cleaning one's glass lenses. The cleaning cloth material (18A, 18B) is attached on the back side of the ends (12, 14) of the outer shell (10) fabric, which comprises the main portion of, and is cut in the shape of, a standard necktie. The lateral edges of the outer shell (10) are then folded around the interlining (16) of the necktie and attached to form a seam traversing the length of the back of the necktie. By the manner of attachment to the back of the necktie, the wipers become outwardly concealed when the necktie is worn, so that the necktie maintains its traditional appearance.

9 Claims, 3 Drawing Sheets

NECKTIE WITH ATTACHING OUTWARDLY CONCEALED EYEGLASS WIPING DEVICE

BACKGROUND—FIELD OF INVENTION

In one aspect, the present invention relates to portable wipers for glass lenses, including eyeglasses and sunglasses. In another aspect, the invention relates to a necktie. In particular, the invention relates to a portable wiper for glass lenses that is permanently attached and concealed on the back of a necktie.

BACKGROUND—DISCUSSION OF PRIOR ART

Since the invention of eyeglasses, eyeglass wearers have been faced with the problem of oily and greasy smears and smudges that often times result from handling the lenses, and since the advent of the silk necktie tie as standard business attire, eyeglass-wearing professionals have found themselves using their own neckwear as an impromptu device for attempting to remove such smudges. Left uncleaned, the smears and smudges on one's eyeglasses can blur one's vision through the lenses, and can also create an unkempt and unprofessional appearance for the professional. Unfortunately for the myopic professional, neither the silk outer-shell nor the acetate or polyester taffeta tipping material currently used in the manufacture of ties offer effective cleaning results. Instead, these materials merely smear the oily smudges even further around the area of the lenses.

Since the recent introduction of high-density, super-fine fibrous cleaning cloth, optometrists have begun recommending the use of pieces of such special cleaning cloths as the best way to clean eyeglass lenses, due to the fact that such cloths provide a quick, effective and scratch-free means of cleaning lenses. However, even though such pieces of cloth are available to consumers, eyeglass wearers often forget to carry them with them. Thus, for the eyeglass-wearing professional, there is a need for an invention that already attaches a cleaning cloth to an article of clothing that is frequently worn by the professional, such as a necktie.

However, as the centerpiece of traditional professional attire, the necktie receives focused attention in the business setting. As a result of such attention, although colors and design patterns may vary with personal tastes, most professionals are reticent to wear any necktie that varies from the traditionally constructed tie. Thus, in creating a tie that contains a cleaning device, there is a need for such device to have minimal affect on the standard/professional appearance of the necktie when worn.

In examining the prior art for the present invention, one must consider both the prior art with respect to portable eyeglass wipers, as well as the prior art regarding neckties.

In the prior art in the field of "cloth cleaner" lens cleaning devices, none of the prior art devices permanently attach the lens cleaning device to a frequently worn item of attire as a means of ensuring that one "remember" to bring the cloth along each day.

U.S. Pat. No. 5,457,842 (Chang) attempted to address this disadvantage in the prior art by disclosing a portable eyeglass wiper consisting primarily of a ring attached to a pair of tongs that have two pieces of cleaning cloth attached. The ring was structured so that it could be hooked to one's pants or beltloop. However, even with the benefit of the ring, Chang's invention is limited in its attempt to provide a portable wiping device that will not be left behind by the eyeglass wearer. This is because an eyeglass wearer will be just as likely to forget to attach Chang's wiper to his or her person as one would be to forget to simply place a piece of such cleaning cloth in one's pocket in the first place. Furthermore, a professional is unlikely to wear Chang's invention in the conservative business-place setting, as it may draw undesired attention or possibly look unprofessional. Thus, by permanently attaching and hiding the cleaning cloth on the back side of a necktie, the present invention provides the eyeglass-wearing professional with a device that will automatically be brought along, without thought, whenever the necktie is worn, while simultaneously concealing it undesired attention.

Prior art in the field of tie construction, including, for example, U.S. Pat. No. 4,506,389 (Franklin), U.S. Pat. No. 4,935,964 (Panton) and U.S. Pat. No. 5,870,776 (Blackman), teaches the basic art of tie making. However, no prior art suggests the improvement of a tie for the new and unexpected purpose of making it especially suitable for use as a eyeglass-cleaning device.

Per Blackman, Franklin and Panton, a tie is typically comprised of three components: the outer shell, the interlining and the tipping. As prior art demonstrates, each of these components has distinct functions related to the overall construction of the necktie. The outer shell is the patterned material, usually made of silk, that is intended to be visible when the necktie is being worn. The interlining, which is fastened inside of the outer shell, functions to provide the shape, body and stability to the necktie.

As for the tipping, Blackman notes that the purpose of the tipping is "to bind the ends of the shell around the interlining . . . clos[ing] the ends of the completed tie, giving it a finished look and keeping the interlining from being exposed or from sliding out if the stitch holding the interlining to the underside of the shell fabric were to break." Acetate or polyester taffeta are the materials traditionally used for tipping. Since these materials are relatively cheap to manufacture and have a silk-like sheen, they serve the tie-construction and aesthetic-related purposes described above (i.e., providing a covering over the interlining and offering a "finished look"). However, as noted earlier, neither of these materials are suitable for or in any way made for cleaning glass lenses. Rather, when any such cleaning is attempted, these materials at a minimum smear the oily smudges even further around the area of the lenses, and can even scratch the lenses themselves.

Thus, prior art for tie-making lacks any suggestions that a special eyeglass cleaning cloth material should be used as the tipping of a necktie, thereby giving the tipping a new and previously unexpected functional use as an eyeglass cleaner that would exist in addition to those tie-construction and aesthetically-related purposes discussed above. Whereas several prior art teachings demonstrate standard tipping shape and construction-function for neckties, the present invention improves upon this standard for a new and unexpected purpose: using a material with special glass-cleaning qualities as the tipping material in order to serve the purpose of providing tie-wearers with a concealed yet convenient means of cleaning their glasses.

In summary, this new invention solves the disadvantages of prior art in portable wiping devices while simultaneously offering a new quality to the standard necktie that is unsuggested by prior art in tie making. In addition, given the fact that tie-wearers have also been eyeglass wearers for decades, if the present invention were in fact obvious, because of the advantages offered thereby, those skilled in the art surely would have implemented such an invention by now.

OBJECTS AND ADVANTAGES

Accordingly, several objects and advantages of the present invention are:

(a) to provide a portable eyeglass wiping device that, as incorporated as part of a standard piece of business attire, the necktie, will offer the advantage of always being readily available for the eyeglass-wearing/tie-wearing professional;

(b) to provide a necktie to which is attached a material that is especially manufactured for cleaning glass lenses, offering the wearer the advantage of providing an highly effective, scratch-free means of lens cleaning by using the necktie itself;

(c) to provide an eyeglass wiping device that is outwardly concealed by being placed on the back of the necktie so as to offer the advantage of maintaining the traditional and professional look of the front of the necktie and the advantage of not calling undesired attention thereto;

(d) to provide an eyeglass wiping device that is fixed to the back of necktie in such a manner that, when viewed from the back of the necktie, the traditional look of the necktie itself is maintained, so as to offer the advantage of maintaining the traditional and professional look of the back of the necktie and the advantage of not calling undesired attention thereto; and (e) to provide a necktie to which is attached a material that, while being especially manufactured for cleaning glass lenses, is also available at a low cost, offering the advantage of minimizing or eliminating any extra expenses to the manufacturer of such invention.

Still further objects and advantages will become apparent from a consideration of the ensuing description and drawings.

LIST OF REFERENCE NUMERALS

10 Outer Shell
12 Large End
14 Small End
16 Interlining
18A Large End Tipping/Cleaning Device
18B Small End Tipping/Cleaning Device

SUMMARY

The present invention comprises a cleaning cloth wiping device for glass lenses that is permanently attached to the back of each of the ends of a necktie, thereby providing the eyeglass wearing professional an immediately available means of cleaning one's glass lenses, which such means is outwardly concealed from view.

DESCRIPTION OF INVENTION

Figure 1:
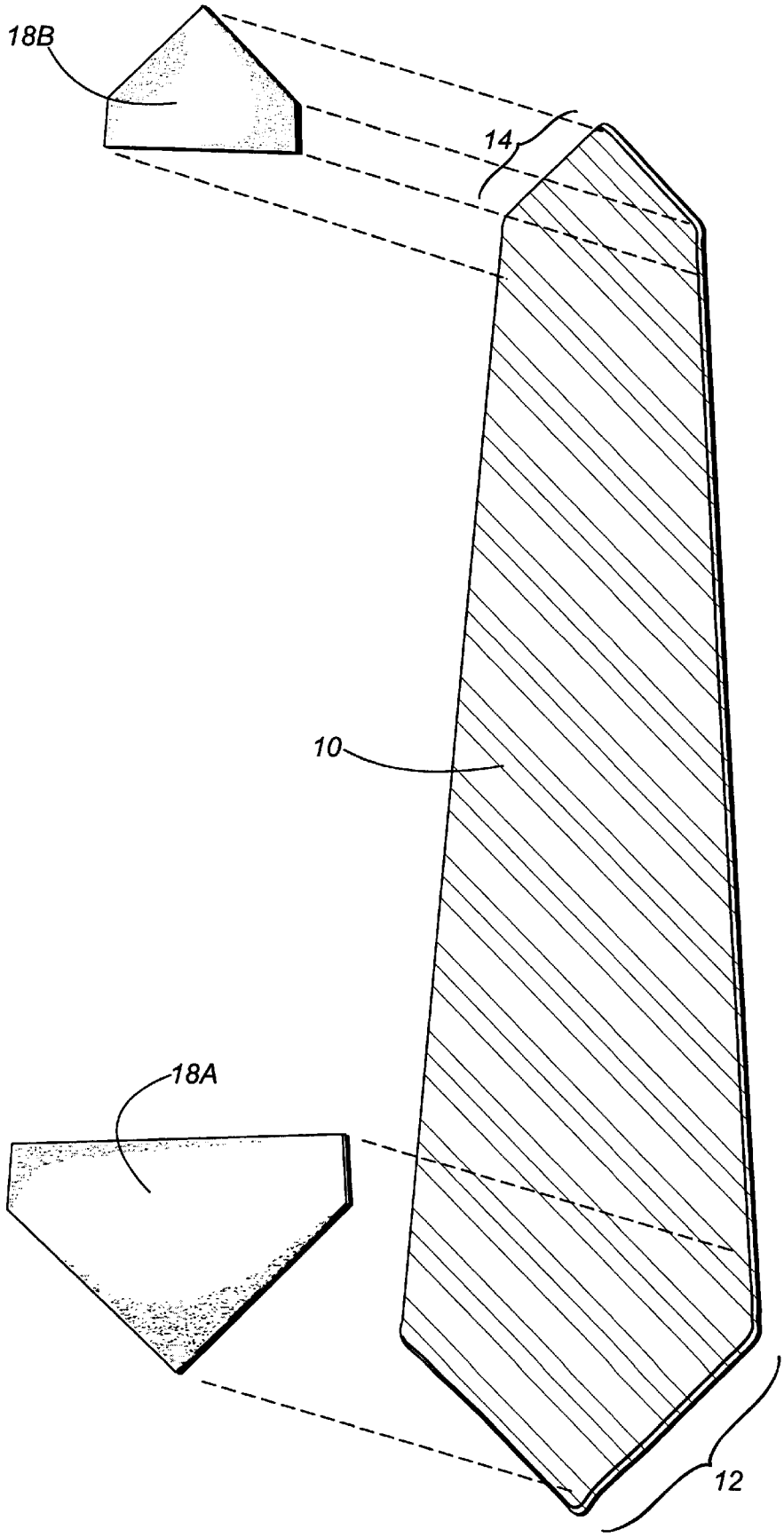
FIG. 1 shows the "front side" of the outer shell of the necktie and the large end and small end tipping/cleaning cloth devices separately cut.

Referring to FIG. 1, an outer shell 10 is cut from and comprised of a patterned fabric sheet (typically silk) in the preferred shape, typically with a tapered large end 12 and a tapered small end 14. The outer shell can be comprised of one long cut piece, or of two or more pieces sewn end to end to form the lengthy shape required. The large end tipping/cleaning device 18A, comprised of a cloth with special lens cleaning properties (e.g., a super-fine synthetic fibrous cloth), and small end tipping/cleaning device of the same material 18B are cut to the indicated shape, with respective ends having the same geometric shape as the ends 12, 14 of the outer shell 10.

Figure 2A:
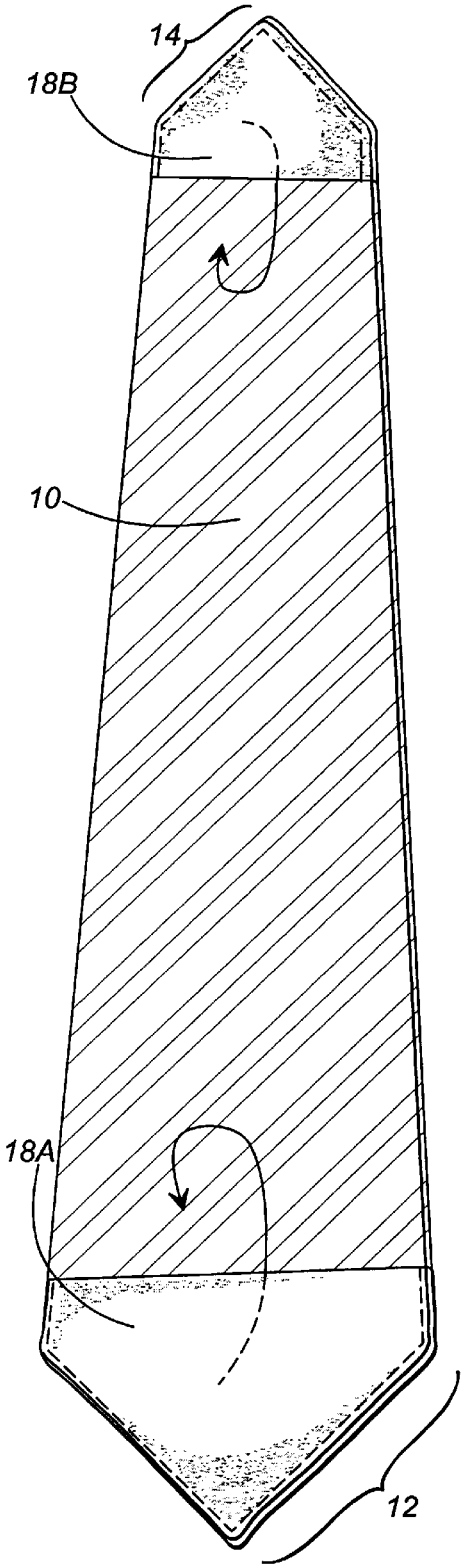
FIG. 2A shows the "front side" of the outer shell of the necktie and the large end and small end tipping/cleaning cloth devices as attached, indicating the manner in which, once such attachment is made, the outer shell is turned "inside out."
Figure 2B:
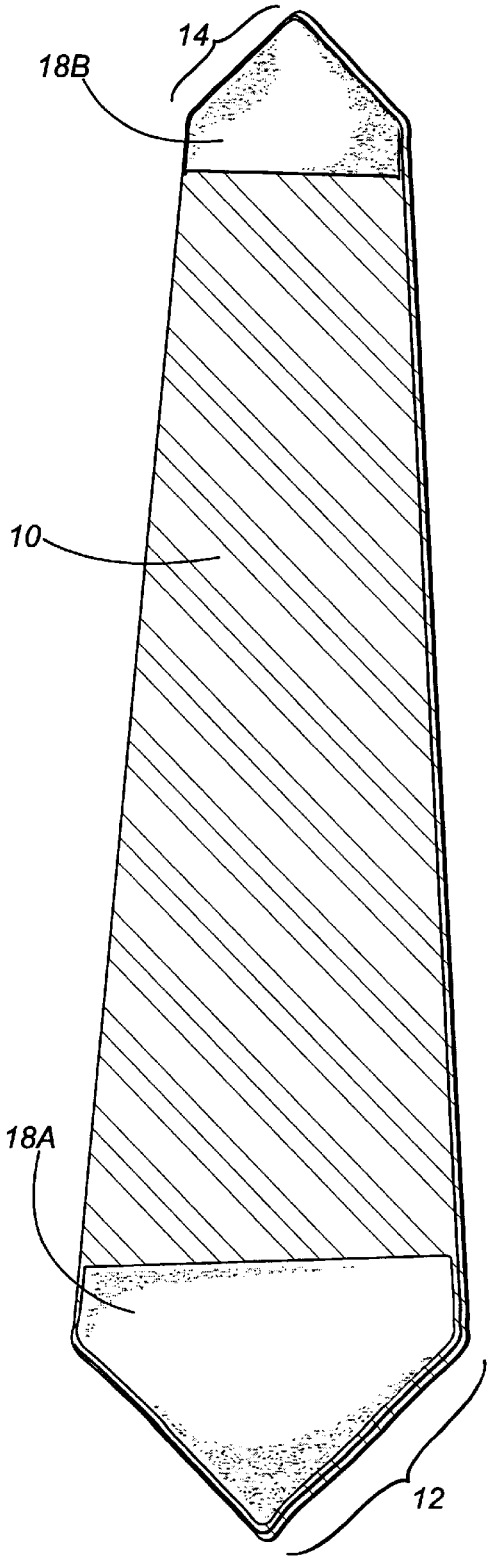
FIG. 2B shows the "back side" of the outer shell of the necktie as it would appear after it has been turned "inside out" as indicated in FIG. 2A.

FIG. 2A shows the front side of the necktie. Referring to FIG. 2A, the large end tipping/cleaning device 18A and small end tipping/cleaning device 18B are typically stitched on the two distal ends and lateral edges as indicated (but may be attached otherwise) onto the front of the outer shell 10, leaving the non-distal ends thereof unattached to the outer shell, 10 forming pockets at each end 12, 14 of the outer shell 10. As further indicated by the arrows, these pockets are then turned "inside out" so that any raw or fringed edges of the outer shell 10, large end tipping/cleaning device 18A or small end tipping/cleaning device 18B are inside the pocket, giving the tips of the ends 12, 14, a finished exterior appearance, as shown in FIG. 2B, which shows the back side of the necktie after the pockets are turned "inside out." Note that, as a result of the pocket turn, the pockets formed by the tipping/cleaning devises 18A, 18B end up being positioned on the back side of the outer shell 10 as shown in FIG. 2B, leaving the front of the outer shell 10 clean in appearance, as originally shown in FIG. 1.

Figure 3:
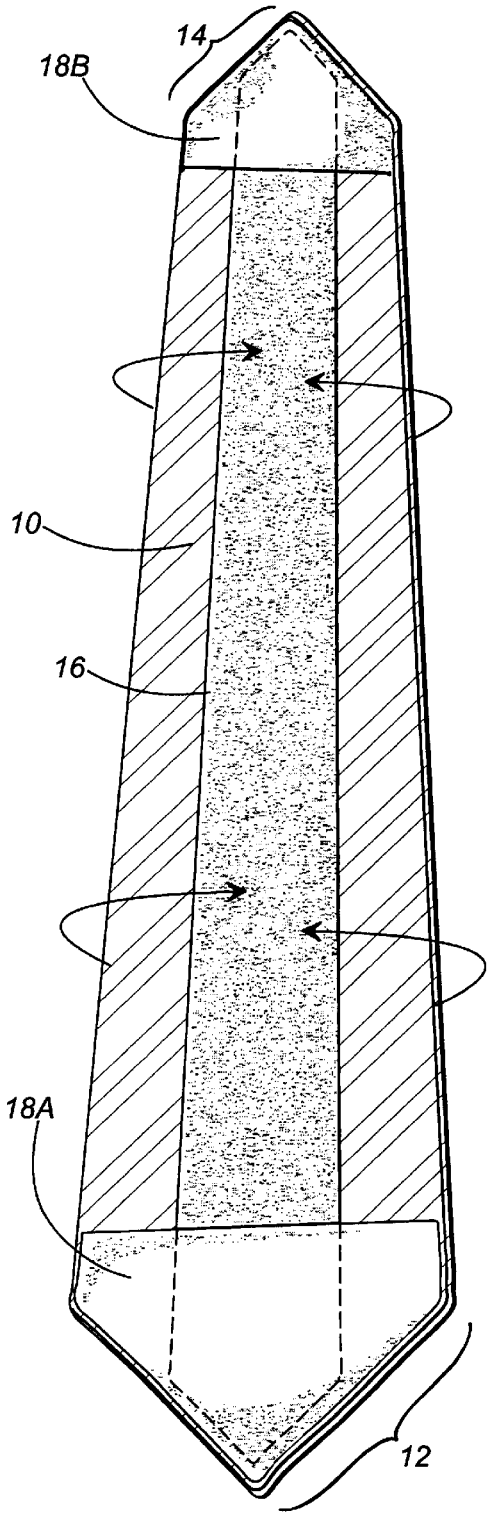
FIG. 3 shows the "back side" of the necktie as it would appear with the interlining positioned on top of the outer shell and into the pockets formed by the tipping/cleaning devices.

FIG. 3 shows the back side of the necktie. Referring to FIG. 3, an interlining material 16 of one or more plies, which is cut to the required shape of the necktie (and which is thinner than the outer shell 10, but equally as long), is placed and attached (by stitching or otherwise) onto the back of the outer shell 10, with ends of the interlining 16 inserted into the pockets formed by the large end tipping/cleaning device 18A or small end tipping/cleaning device 18B at each of the ends of the outer shell 12, 14. The outer lateral edges of the outer shell 10 are then folded, creased and pressed along and over the lateral edges of the interlining material 16 towards the middle of the interlining material 16.

Figure 4A:
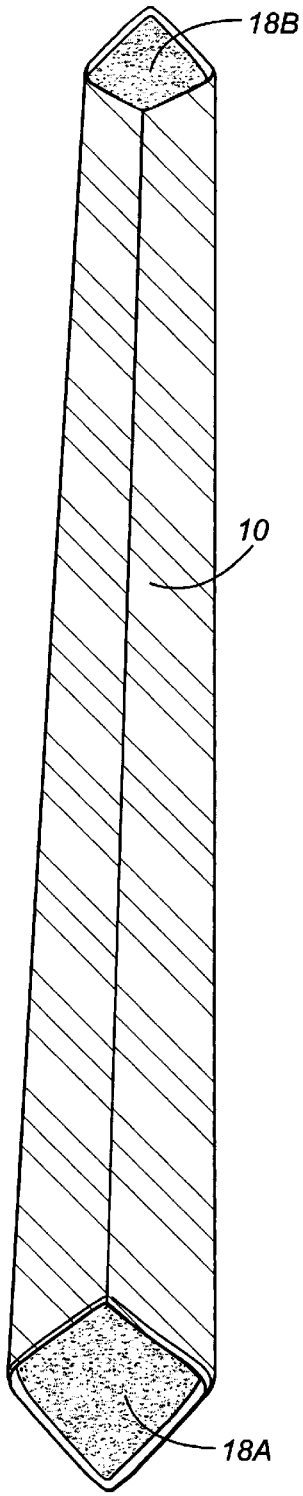
FIG. 4A shows a view of the "back" side of the necktie as it would appear as finished.
Figure 4B:
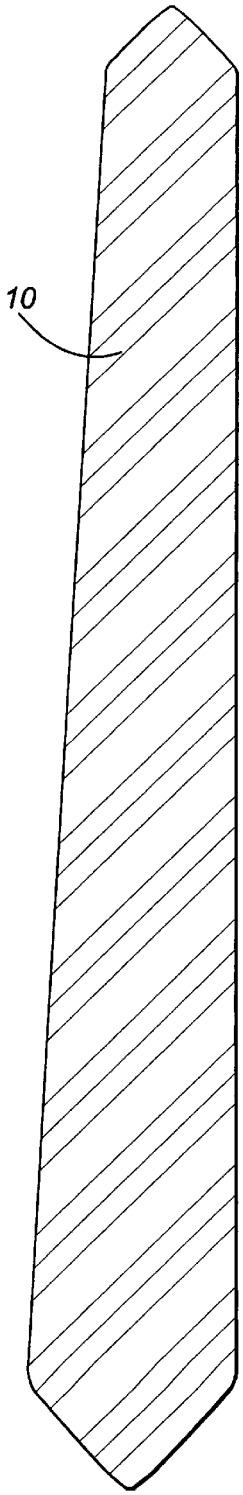
FIG. 4B shows the finished necktie from the "front" view, showing the outer shell that would face away from the wearer when worn.

Referring to FIG. 4A, the outer lateral edges of the outer shell 10 are then attached (by stitching or otherwise) together to form a seam down the length of the necktie, thus completing the necktie and giving the back of the necktie the appearance indicated in FIG. 4A, and the front of the necktie the appearance indicated in FIG. 4B.

From the foregoing detailed description, it will be evident that there are a number of changes, adaptations and modifications of the present invention which come within the province of those skilled in the art (e.g., a "clip-on" or "pre-knotted" necktie with concealed cleaning device, necktie with differently shaped, perhaps square, ends with concealed cleaning device or necktie with only one end containing the cleaning device). However, it is intended that all such variations not departing from the spirit of the invention be considered as within the scope thereof as limited solely by the claims attached hereto.

OPERATION OF INVENTION

The manner of using the necktie with attaching outwardly concealed eyeglass wiping device can vary depending on the preference of the wearer. First of all, the necktie is tied and worn around the one's neck as any standard necktie. Then, whenever the wearer's eyeglass lenses become dirty, the wearer can hold the eyeglasses in one hand, while using the other to grasp either one or both ends 12, 14 of the necktie, using the cleaning cloth devices 18A, 18B concealed on the back thereof to clean the lenses as desired.

CONCLUSION, RAMIFICATIONS AND SCOPE OF THE INVENTION

Thus, the reader will see that the present invention provides a portable eyeglass wiping device that, as incorporated as part of a standard piece of business attire, the necktie, offers the advantage of always being readily available for (and not to be forgotten by) the eyeglass-wearing/tie-wearing professional. Furthermore, by using a cleaning cloth with specific qualities required for cleaning glass lenses as the wiping device, the wearer obtains the advantage of having immediately available an highly effective, scratch-free means of lens cleaning not offered by current neckties. In addition, since the wiping device is outwardly concealed on the back of a necktie, the wearer can be comfortable that the necktie maintains the traditional and professional look of the front of the necktie, without calling undesired attention thereto. Similarly, since the eyeglass wiping device is fixed to the back of necktie in such a manner that, when viewed from the back of the necktie, maintains the traditional look of the back of the necktie, the wearer can be comfortable that undesired attention will not be called to the necktie. Finally, since cleaning cloths are typically inexpensive to manufacture, manufacturers will not incur any significant additional cost in producing the invention over the cost of producing a standard necktie.

While the description of the invention contains many specificities, these should not be construed as limitation on the scope of the invention, but rather as an exemplification of one preferred embodiment thereof. Many other variations thereof are possible (e.g., a "clip-on," "pre-formed" or "pre-tied" necktie with concealed cleaning device, necktie with differently shaped, perhaps square, ends with concealed cleaning device, necktie with only one end containing the cleaning device, necktie using longer or shorter cleaning cloths, variations in color, etc.). Furthermore, other uses of the concealed cleaning device besides cleaning eyeglass lenses are possible (e.g., cleaning computer screen, belt buckles, hand mirrors, etc.)

Accordingly, the scope of the invention should be determined not by the embodiment illustrated, but by the appended claims and their legal equivalents.

We claim:

1. A necktie capable of efficiently cleaning glass, wherein the necktie has a front side and a rear side, and wherein the front side is visible when the necktie is being worn, comprising:

an outer material having a decorative side, a back side opposite the decorative side, a first end, a second end opposite the first end, and two sides extending substantially from the first end to the second end, wherein the two sides are folded towards the back side of the outer material to create an envelope;

an interlining for providing shape and body to the necktie, the interlining having a first end, a second end, and a lengthwise portion connecting the first end to the second end, wherein the first end is disposed substantially adjacent the first end of the outer material, and wherein the lengthwise portion is disposed within the envelope, and a microfiber cloth for cleaning glass, wherein the microfiber cloth is fixed to the rear side of the necktie.

2. The necktie of claim 1, wherein the microfiber cloth for cleaning glass is a super-fine synthetic fibrous cloth for cleaning glass.

3. The necktie of claim 1, wherein the microfiber cloth for cleaning glass is concealed when the necktie is worn.

4. A necktie capable of efficiently cleaning glass, wherein the necktie has a front side and a rear side, and wherein the front side is visible when the necktie is being worn, comprising:

an outer material having a decorative side, a back side opposite the decorative side, a first end, a second end opposite the first end, and two sides extending substantially from the first end to the second end, wherein the two sides are folded towards the back side of the outer material to create an envelope;

an interlining for providing shape and body to the necktie, the interlining having a first end, a second end, and a lengthwise portion connecting the first end to the second end, wherein the first end is disposed substantially adjacent the first end of the outer material, and wherein the lengthwise portion is disposed within the envelope, and a microfiber cloth for cleaning glass, wherein the microfiber cloth is fixed to the outer material on the rear side of the necktie and wherein the microfiber cloth overlaps at least a portion of the first end of the interlining.

5. The necktie of claim 4, wherein the microfiber cloth for cleaning glass is a super-fine synthetic fibrous cloth for cleaning glass.

6. The necktie of claim 4, wherein the microfiber cloth for cleaning glass is concealed when the necktie is worn.

7. A necktie capable of efficiently cleaning glass, wherein the necktie has a front side and a rear side, and wherein the front side is visible when the necktie is being worn, comprising:

an outer material having a decorative side, a back side opposite the decorative side, a first v-shaped end, a relatively smaller second v-shaped end opposite the first v-shaped end, and two sides extending substantially from the first v-shaped end to the relatively smaller second v-shaped end, wherein the two sides are folded towards the back side of the outer material to create an envelope and a seam extending substantially from the first v-shaped end to the second v-shaped end on the rear side of the necktie;

an interlining fabric for providing shape to the necktie, wherein the interlining fabric includes a first end, a second end, and a lengthwise portion connecting the first end to the second end, wherein the interlining fabric extends substantially from the first v-shaped end to the relatively smaller second v-shaped end, and wherein the lengthwise portion is disposed within the envelope, and a microfiber cloth for cleaning glass, wherein the microfiber cloth is fixed in part to the first v-shaped end of the outer material on the rear side of the necktie, and wherein at least a portion of the first end of the interlining fabric is disposed between the microfiber cloth and the first v-shaped end of the outer material.

8. The necktie of claim 7, wherein the microfiber cloth for cleaning glass is a super-fine synthetic fibrous cloth for cleaning glass.

9. The necktie of claim 7, wherein the microfiber cloth for cleaning glass is concealed when the necktie is worn.

* * * * *